US005233709A

United States Patent [19]

Horry

[11] Patent Number: 5,233,709

[45] Date of Patent: Aug. 10, 1993

[54] BEDSTEAD

[75] Inventor: Yves Horry, Vancouver, Canada

[73] Assignee: N&H Sarl, Auxerre, France

[21] Appl. No.: 594,134

[22] Filed: Oct. 10, 1990

[30] Foreign Application Priority Data

Oct. 10, 1989 [DE] Fed. Rep. of Germany ..... 3933816

[51] Int. Cl.[5] ..... A47C 23/06

[52] U.S. Cl. ..... 5/236.1; 5/191; 5/238

[58] Field of Search ..... 5/191, 236.1, 238, 237

[56] References Cited

U.S. PATENT DOCUMENTS

| | | | |
|---|---|---|---|
| 51,755 | 12/1865 | Schott | 5/236.1 |
| 64,901 | 5/1867 | Pedrick | 5/239 |
| 106,666 | 8/1870 | Cramer | 5/236.1 |
| 268,783 | 12/1882 | Dodge | 5/236.1 X |
| 1,340,510 | 5/1920 | Weissman et al. | 5/191 |
| 2,638,606 | 5/1953 | Austin | 5/236.1 |
| 2,745,473 | 5/1956 | Boland | 5/236.1 X |
| 4,477,935 | 10/1984 | Griffin | 5/236.1 |
| 4,827,544 | 5/1989 | Hüsler | 5/191 |

FOREIGN PATENT DOCUMENTS

| | | | |
|---|---|---|---|
| 3905879 | 8/1990 | Fed. Rep. of Germany | 5/236.1 |
| 299579 | 11/1928 | United Kingdom | 5/239 |

*Primary Examiner*—Peter M. Cuomo
*Assistant Examiner*—Michael J. Milano
*Attorney, Agent, or Firm*—Robert J. Koch

[57] ABSTRACT

A bedstead may be constructed of longitudinal spring bodies and transverse slats. Fastening straps may be connected to the spring bodies and the straps may be loops, slots or holes configured to receive the slat ends. The straps may also include a locking mechanism.

17 Claims, 3 Drawing Sheets

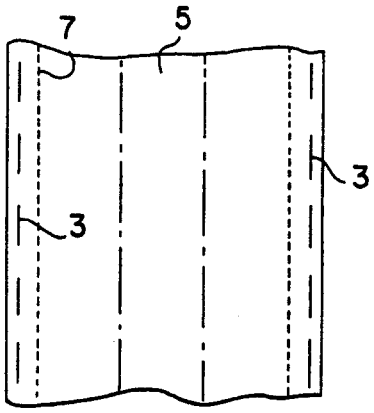
Fig.7
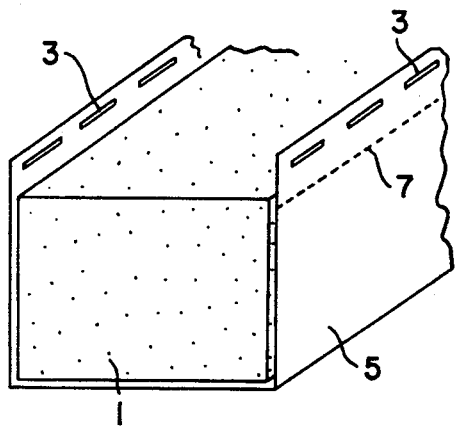
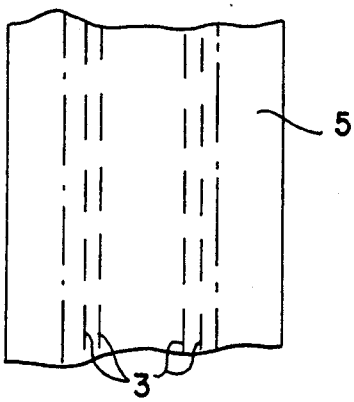
Fig.8
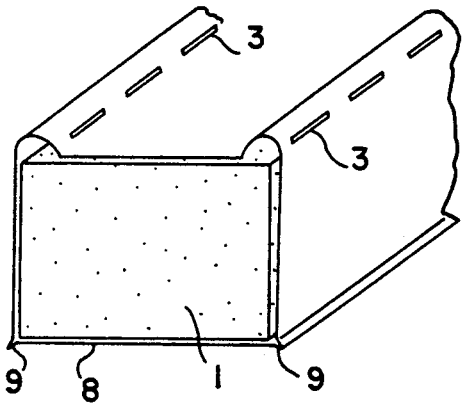
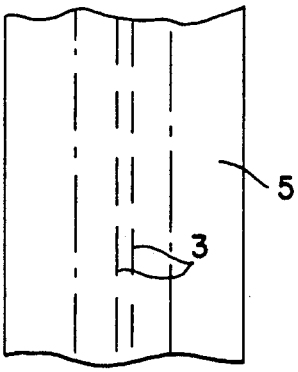
Fig.9
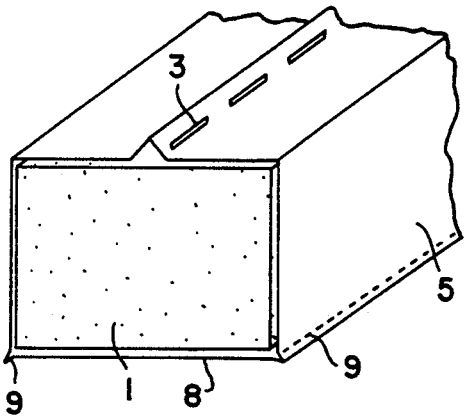
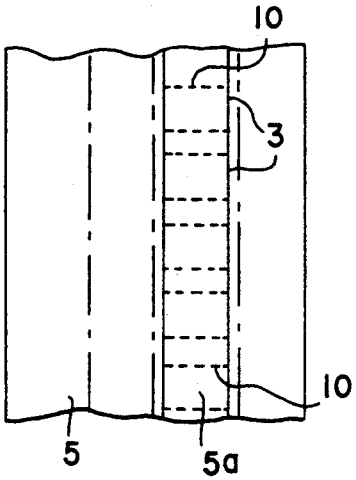
Fig.10
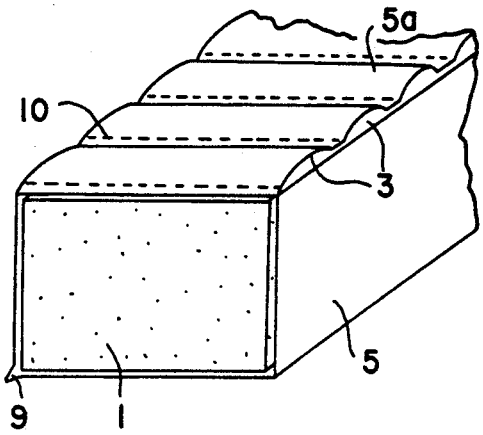

BEDSTEAD

BACKGROUND OF THE INVENTION

1. Field of the Invention

The invention relates to a bedstead or bed frame with longitudinal spring bodies and transversely placed slate.

2. Description of the Related Technology

A bed frame is shown in CH 670945 A5. The spring bodies are secured by a sheet covering the entire surface. Pockets are provided to hold the slats on top of the sheet. Two or more flexible tubes to receive the spring bodies are located on the underside of the sheet. This frame has a number of disadvantages.

The sheet acts as a dust collector and prevents the airing of the bottom side. Also, the sheet may stretch after extended use and fail to hold the slats.

SUMMARY OF THE INVENTION

It is an object of the invention to provide, based on the aforementioned state of the art, a bedstead which insures a relatively durable hold between the spring bodies and the slats of a slat frame. The invention allows free, unimpaired airing of the bed covering, using little material, and is capable of being produced in a cost effective manner. According to the invention, the bedstead may be used without a separate bed frame.

The object may be attained by providing fastening straps with loops, slots or holes to hold the slat ends. The fastening straps are combined with the spring bodies and equipped with means to hold the slats in place.

The invention has a surprising number of advantages.

First, no sheet covering the entire surface is required, according to the invention. Rather, a narrow strap is sufficient for the relative attachment of the slats to the spring bodies. The straps require only a small fraction, for example a one-hundredth part, of the sheet material needed heretofore.

Another advantage of the invention is that the underside of the bedstead is entirely free. Air is able to flow without hindrance from below to the slats and between them to the upper part of the bed, for example a mattress. The bed is thus able to breath.

A further advantage of the invention is that the fastening straps cooperate with the slats to permanently immobilize the slats. Even if the fastening straps stretch slightly, the slats cannot be displaced relative to the spring bodies, as long as the lateral height of the recesses is larger than the extension of the engaging edges of the loops, slots or holes. Therefore, it is not absolutely necessary to make the fastening strap from a material with a minimum lateral expansion. There is a great freedom in selecting the material.

Advantageously, the manufacture of both the fastening strap and the securing means may be highly cost effective. The production of looped, slotted or perforated straps by advanced methods of synthetic textile weaving and by computer controlled water jet cutting processes in the case of being carried out efficiently and economically.

According to the invention, the slats of a slat frame are economically and effectively fastened to the spring bodies of a bedstead.

Recesses in the slats may be provided as a securing mechanism. The recesses engage the narrow looped, slotted or perforated edges of the fastening strap. The recesses may be notches or grooves in the slats. In any case, the recesses may be produced in a simple manner.

It is possible to provide the recesses on the upper and/or lower edges of the slats only. In the latter case, their hold is assured even if the strap should yield and stretch with time.

The fastening strap ma be combined with a cloth covering the spring body. The fastening strap may be sewn to the cloth or integrated in a single piece of cloth. This further development of the invention has the advantage that covering the spring body and providing the fastening strap may be effected by a single manufacturing step.

According to a further development of the invention, the cloth covering the spring body may have fasteners such as snaps or other fasteners for connecting the fastening straps to the spring bodies or the slats in the openings. The openings allow the spring body to engage the fastening straps. The spring suspension of the bedstead and thus of the entire bed may be adapted to the weight of the person sleeping in the bed. Such an adaptation is possible even after the purchase of the bed.

The fastening strap may be adhesively bonded directly to the spring material. This embodiment is appropriate when the spring body is made of a material requiring no covering.

According to another embodiment of the invention, the spring body may be made of two or more segments. The segments may be connected by loops which are long enough to reach the first or second slat of the next spring body segment. These loops may be connected by looping around the end of the corresponding slat. It is also possible to combine the two loop ends into a single loop by a snap fastener connection. This segmenting of the spring bodies may be used in a folding bedstead. Readily transported folding beds may be manufactured in this manner Folding bedsteads may advantageously be used for guests or for camping.

A fastening strap may be provided for every spring body. This fastening strap may be placed in a centered location. Alternatively, the strap may also be aligned flush with the inside or the outside of the spring body. There is no risk that the slat frame will roll over the spring body as long as this bottom part of the bedstead is not laterally displaceable, such as in a bed frame.

This unilateral layout affords another appreciable material savings. Due to the symmetry of the bedstead, the same fastening strap may be used, regardless of whether it is placed outside or inside the spring body. This is true even if the strap is in a single piece with the cloth covering the spring body.

Two parallel fastening straps may be applied to each spring body of the bedstead. The straps may conveniently be flush with the inside or outside of the spring body. This further development of the invention is especially advantageous if the bedstead is used without side walls, for example in the case of a camping bed.

The securing means may be wide grooves. The sides of the grooves prevent sliding between the fastening strap and the slats. The grooves may be wide enough to receive two fastening straps. The grooves may also be designed to receive and secure flat placed straps. The latter straps may be double layer straps, for example 2 to 4 cm wide, and sewn together in a manner such that they have pockets spaced apart in keeping with the slats. The slat ends may be inserted so that the straps are located in the groove and the lateral edges of the straps are within the lateral walls defining the wide groove.

The invention will become more apparent from the example described with reference to the drawings.

BRIEF DESCRIPTION OF THE DRAWINGS

FIGS. 7–10 each show on the left side a flat fastening cloth and on the right side the fastening cloth in its working position connected to a spring body.

DETAILED DESCRIPTION OF THE PREFERRED EMBODIMENT

Figure 1:
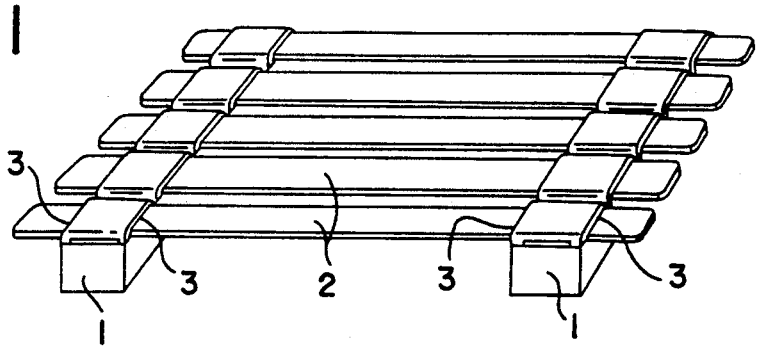
FIG. 1 is a perspective view of a bedframe according to the invention.

FIG. 1 shows slats 2 of a slat frame on two spring bodies 1. The slat ends pass through slots 3 defined by fastening straps 5. In this embodiment, a fastening strap may be provided on both sides of each fastening body.

Figure 2:
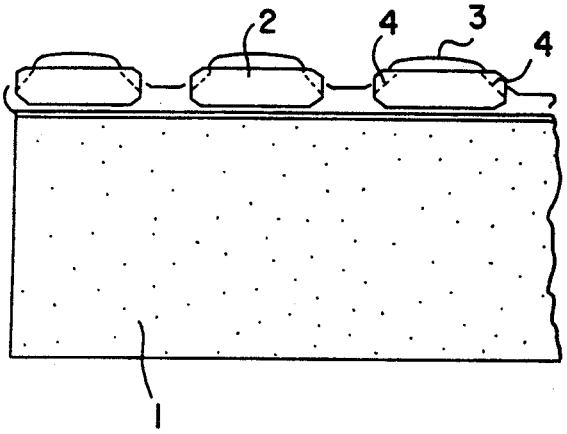
FIG. 2 is a lateral view of the bedstead.

FIG. 2 shows a lateral elevation of the bedstead of FIG. 1. The broken lines illustrate that parts of the inner edges of the slots or holes of the slotted or perforated strap 5 are positioned in recesses 4 in the slats. In this layout, the slats are positively connected to the fastening straps, which in turn are fastened to the spring bodies.

Figure 3:
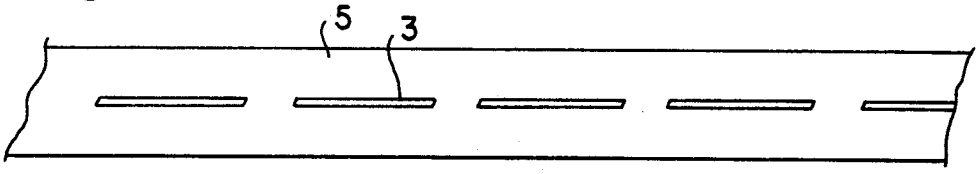
FIG. 3 is a fastening strap with slots or button holes.

FIG. 3 shows a slotted or perforated strap 5 with button holes 3. This fastening strap is connected to the spring body. The spacing of the slots 3 determines the spacing of the slats 2 of the slatted frame.

One end of the slat is inserted through each of the slots until the edge of the slot 3 engages a locking recess of the slat.

Figure 4:
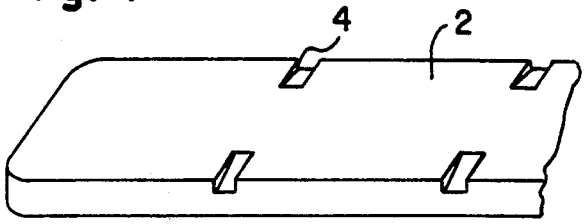
FIG. 4 shows one end of a slat of a slat frame with locking notches.

The locking recesses seen in FIG. 4 are narrow grooves 4. The groove depth should be high enough so that as the fastening straps stretch over time, they do not deform enough to disengage the strap from the slat grooves. In this manner, the slats 2 are securely fastened in the fastening straps slots and thus to the spring bodies.

Advantageously, the grooves may be present only on one end of the slats so that they may be introduced into a slot 3 in an especially simple and rapid manner.

The slat may be rotated so that the groove 4 is located downward. The slat end, in this orientation, is inserted through the slot 3 until the groove is located in the plane of the slot. The slat is then rotated 180° around its longitudinal axis, so that the groove is on the top side and the upper edge of the slot 3 is in the groove. The slat is securely immobilized in this position.

The fastening straps may be as narrow as desired. The only criteria are strength and durability.

Figure 5:
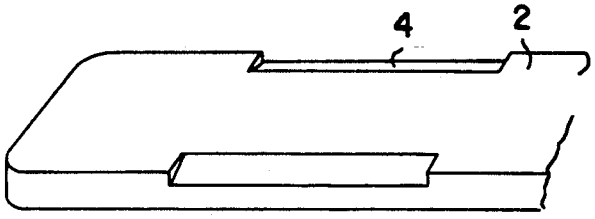
FIG. 5 shows one end of a slat with wide locking grooves.

According to an alternative embodiment shown in FIG. 5, the slats 2 may have wide grooves 6. These grooves may be approximately as wide as a spring body. In this case, each groove can accommodate two slotted straps.

This wide configuration of the grooves 6 makes possible another type of fastening of the slats 2 on the spring bodies. Double layer straps, sewn together to define pockets at the appropriately spaced intervals, may be used to fasten the slats. If a slat 2 is inserted into such a pocket, one layer lies flat under the slat and the other layer of the slat flat on top of the slat in the groove 6.

Figure 6:
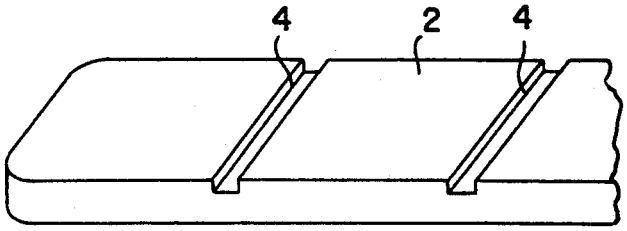
FIG. 6 shows one end of a slat of a slat frame with narrow, continuous grooves.

FIG. 6 shows a slat end similar to that of FIG. 4. The difference is that in the example of FIG. 6 the grooves are located transversely over the entire surface of the slat 2. It is simpler to manufacture grooved slats according to this embodiment.

FIG. 7 shows a flat fastening cloth on the left and the same cloth in a fastening position with the spring body 1 on the right. As shown on the left side of the view cf FIG. 7, slots 3 are arranged tightly adjacent and parallel to the left cloth edge to receive the slat ends. The dots indicate the area which will be located at the height of the upper edge of the spring body as shown in the right side of FIG. 7. Further to the right, two dash-and-dot lines indicate the folds. The dotted line 7 and the row of slots 3 are illustrated still further to the right.

The right hand view of FIG. 7 shows this fastening cloth folded and wrapped around the spring body 1. The dash and dot folds are located at the lower left longitudinal edge of the spring body 1 and at the lower right longitudinal edge of said spring body 1. The rows of slots 3 in this position are above the upper edge of the spring body 1, so that the slats may be inserted without hindrance with their edges always through two aligned slots 3, until the corresponding slot edges are located in the locking grooves 4.

It is seen, therefore, that the fastening straps 5 shown in FIG. 3 from right and left edges and are part of the fastening cloth.

If the top side of the spring body 1 of FIG. 7 is also to be covered with a cloth, it is conveniently combined with said cloth, for example sewn together along the dotted line 7.

FIG. 8 shows an embodiment of a flat fastening cloth 5 on the left and the spring body 1 covered by the cloth 5 on the right. Here, two rows of double slots 3 are provided on the cloth 5. The fastening cloth 5 is advantageously placed from above around the spring body 1 so that the cloth 5 is arched on both sides, with the two double slots 3 aligned with each other. A bottom sole 8 is located on the bottom side of the spring body 1. The bottom right and bottom left seams connect the fastening cloth to the bottom sole 8. The bottom sole may be a particularly strong material, especially if the bedstead is to be set directly on the floor or used outdoors.

The folds are indicated in the left view by dotted lines in FIG. 9. The left hand view of FIG. 9 shows a flat fastening cloth and the right hand view shows the fastening cloth, in its working position, around the spring body 1. The fastening cloth of FIG. 9 has two central adjacent rows of slots 3. The slots are aligned with each other, above the spring body 1, in their working position. The dash-and-dot lines in FIG. 9 indicate the fold lines. The fastening cloth 5 is joined to a sole 8 along the connecting seams 9.

The left hand view of FIG. 10 shows a flat fastening cloth 5. A second strap **3*a* is sewn to the cloth 5, along the dotted lines, in a manner such that pocket-like passages are formed. As seen in the right hand view of FIG. 10, pockets 3 are formed in this fashion. The pockets are then located on top of the spring body 1. In this example, flat fastening straps 3*a* are used. The flat fastening straps 5*a* fit into the wide grooves 4 of FIG. 5. The groove width 4 and the width of the second strap 5*a*** are correlated with each other.

What is claimed:

1. A bedstead comprising:

at least two longitudinally oriented spring bodies;

a fastening strap having loops, slats or holes disposed on each spring body;

a plurality of transverse slats extending between said spring bodies wherein said slats exhibit a broad groove, and where a side of said groove engages said loops, slots or holes of said strap; and a cover surrounding said spring body connected to an associated fastening strap.

2. A bedstead according to claim 1, wherein said fastening straps are located essentially perpendicularly to said slats.

3. A bedstead according to claim 2, wherein said fastening straps are textile.

4. A bedstead according to claim 3, wherein said textile is a synthetic material.

5. A bedstead according to claim 1, wherein said said cover surrounding said spring body connected to an associated fastening strap, is a cloth cover.

6. A bedstead according to claim 5, wherein said fastening strap and said cloth are a single integrated piece

7. A bedstead according to claim 5, further comprising fasteners connected to said cloth.

8. A bedstead according to claim 1, wherein said fastening strap is adhesively bonded to said spring body.

9. A bedstead according to claim 1, wherein each spring body comprises at least two segments and a loop configured to connect a segment to a slat of an adjacent segment.

10. A bedstead according to claim 1, wherein at least one fastening strap is connected to each spring body

11. A bedstead according to claim 10, further comprising two parallel fastening straps connected to each spring body

12. A bedstead according to claim 1, wherein said groove in said slat is wide enough to hold two fastening straps of a spring body.

13. A bedstead according to claim 1, wherein said groove is configured to hold a flatly oriented fastening strap.

14. A bedstead comprising:

at least two longitudinally oriented spring bodies;

a fastening strap, exhibiting loops, slots, or holes, disposed on each spring body;

a plurality of transverse slats extending between said spring bodies wherein said slats each exhibit one or more recesses and are configured to engage at least one of said loops, slots or holes of said fastening strap; and a cover surrounding said spring body connected to an associated fastening strap.

15. A bedstead according to claim 14, wherein said recesses are notches.

16. A bedstead according to claim 15, wherein said notches are grooves.

17. A bedstead according to claim 14, wherein said slats exhibit recesses only on a single edge.

* * * * *